United States Patent [19]

Mayer et al.

[11] Patent Number: 4,778,958

[45] Date of Patent: Oct. 18, 1988

[54] MATERIAL FOR ELECTRIC CONTACTS HAVING ARC-QUENCHING PROPERTIES

[75] Inventors: Ursula Mayer; Roland Michal; Jens Radbruch, all of Pforzheim, Fed. Rep. of Germany

[73] Assignee: Doduco KG. Dr. Eugen Durrwachter, Pforzheim, Fed. Rep. of Germany

[21] Appl. No.: 153,510

[22] Filed: Feb. 8, 1988

Related U.S. Application Data

[63] Continuation of Ser. No. 842,169, Mar. 20, 1986, abandoned.

[30] Foreign Application Priority Data

Apr. 1, 1985 [DE] Fed. Rep. of Germany ..... 3511879

[51] Int. Cl.[4] ..... H01H 33/70

[52] U.S. Cl. ..... 200/144 C; 200/149 A

[58] Field of Search ..... 200/144 C, 149 A

[56] References Cited

U.S. PATENT DOCUMENTS

| | | | |
|---|---|---|---|
| 2,949,424 | 8/1960 | Mandelcorn et al. | 200/144 C |
| 4,011,426 | 3/1977 | Lange | 200/144 C |

FOREIGN PATENT DOCUMENTS

| | | | |
|---|---|---|---|
| 782038 | 4/1968 | Canada | 200/144 C |
| 1640007 | 10/1970 | Fed. Rep. of Germany . | |
| 433481 | 9/1967 | Switzerland | 200/144 C |

OTHER PUBLICATIONS

"Kunststoff Taschenbuch", pp. 394–415.

"Das Loschverhalten Von Wechselstrom-Lichtbogen in Schutzen Bei Ausnutzung der Saulenkuhlung", Oct. 30, 1978, pp. 1, 56–73.

*Primary Examiner*—Robert S. Macon

*Attorney, Agent, or Firm*—Balogh, Osann, Kramer, Dvorak, Genova & Traub

[57] ABSTRACT

The material for electric contacts having arc-quenching properties comprises an irreversibly cured polymeric molding compound, which contains 5 to 20 volume percent of a metal powder and optionally contains up to 40 volume percent of an additional filler consisting of an electrically non-conducting inorganic powder. The selected thermosettable molding compound can be cured without forming a liquid phase.

41 Claims, No Drawings

MATERIAL FOR ELECTRIC CONTACTS HAVING ARC-QUENCHING PROPERTIES

This application is a continuation of application Ser. No. 842,169 filed Mar. 20, 1986 now abandoned.

BACKGROUND OF THE INVENTION

1. Field of the Invention

This invention relates to a material for electric contacts having arc-quenching properties, which material comprises an cured polymeric composition containing a metal powder filler.

2. Description of the Prior Art

Such material is described in U.S. Pat. No. 4,011,426. The materials described in that printed publication contain a metal powder consisting, e.g., of nickel, an electrically non-conducting powder, such as quartz powder, alumina powder or dolomite powder, and a plastic material which releases gases under the action of an electric arc, particularly a plastic material which releases electronegative gases under the action of an electric arc, such as polytetrafluoroethylene. The above-mentioned components of the contact material are held together by a binder. The binders which have been mentioned include thermoset plastics, such as phenol resins, urea resins, melamine resins, and particularly a multicomponent epoxy resin. If an epoxy resin is used, the known materials are made in that the powder components are stirred into a liquid to pastelike resin composition, which in addition to the basic epoxy resin contains a solvent and a hardening agent for curing (crosslinking) the synthetic resin.

Said known materials for electric contacts have not proved satisfactory in switching practice. If the metal powder content is so high that a specific electrical conductivity of at least 0.1 MS/m can be achieved, the burn-off during switching operations will be excessive and the arc-quenching activity will be inadequate. If the metal powder content is reduced in favor of the substances having arc-quenching properties so that an adequate arc-quenching activity is obtained, then the electric conductivity will not be sufficient for a conduction of the cut-off current during the arc-quenching time and the burn-off during switching operations will still be high.

SUMMARY OF THE INVENTION

It is an object of the invention to provide a material which is of the kind described first hereinbefore and which distinguishes by having satisfactory arc-quenching properties, a low burn-off and an adequate electrical conductivity.

That object is accomplished in that the material contains 5 to 20 volume percent metal powder and that the cured polymeric composition has been formed from a molding compound or molding material which is curable without an occurrence of a liquid phase.

Desirable further features of the invention are recited in the dependent claims.

The material in accordance with the invention comprises an cured polymeric composition which permits a predetermined electrical conductivity to be achieved in a material having a lower metal powder content. In accordance with the invention the metal powder content of the polymeric composition is between 5 and 20 volume percent, preferably between 8 and 12 volume percent. Contacts having a satisfactory electrical conductivity can be obtained with such a low metal powder content because the cured materials used in accordance with the invention have been made from molding compounds which can be cured without an occurrence of a liquid phase, particularly by being heated under pressure. In addition to the resin, the molding compounds usually contain fillers, such as rock meal, wood meal.

A difference between the present material and the materials disclosed in U.S. Pat. No. 4,011,426 resides in the fact that no liquid phase is formed as the molding compound is cured. In the known materials, casting resins are used as thermosettable binders. The present inventors have found that a molding compound which is of the kind proposed by the invention and which can be cured without assuming a low-viscosity, molten state will envelop the particles of a metal powder to a much smaller extent than a liquid casting resin composition into which the metal powder particles are stirred and which is subsequently cured. For this reason even a relatively small amount of metal powder in the contact material in accordance with the invention is adapted to form in the polymeric composition a large number of continuous current paths. Otherwise, such low metal contents would be satisfactory only if wires or the like were embedded in the cured plastic to provide continuous current paths. But owing to its non-homogeneous, anisotropic structure such a material would not be satisfactory as an arc-quenching contact material and could be manufactured only at excessively high costs. In the contact material in accordance with the invention a formation of continuous current paths will be promoted by the use of a metal powder in the form of particles consisting mainly of flakes because adjacent flakes may overlap so that they can contact each other more easily than spherical or dendritic powder particles.

Single-component molding compounds can be used in accordance with the invention. Examples of such molding compounds are: Type 802 in accordance wit DIN 16911; Type 3515 available from Bakelite GmbH in D-5680 Iserlohn (an unsaturated polyester resin containing a spherical inorganic filler); Type 870 in accordance with the withdrawn standard DIN 16912; Type 152 in accordance wit DIN 7708. These are thermosettable molding compounds.

Alternatively it is possible to use molding compositions which can be cured by different methods, e.g., by irradiation, if the curing does not involve the formation of a liquid phase.

Satisfactory metal powders have an adequate electric conductivity and specifically include silver powder, copper powder, silvered copper powder. Nickel powder can be used too but has a lower electrical conductivity.

The contact material in accordance with the invention differs from the contact material disclosed in U.S. Pat. No. 4,011,426 in that it does not contain additional organic components, such as polytetrafluoroethylene, which release electronegative gases under the action of an electric arc. In the contact material in accordance with the invention the arc-quenching activity is due only to the decomposition products evolved by the cured material under the action of light, primarily to the hydrogen evolved as the cured material is decomposed, although other gaseous decomposition products, mainly carbon monoxide, contribute to the quenching of the electric arc. Different from the composition of, e.g., polytetrafluoroethylene, the arc-quenching activity of said decomposition products is not due to the fact that they are electronegative but to the fact that they flow axially in contact with the arc column and effectively cool said column and that their cooling action is promoted by their high thermal conductivity.

The inventors have also found that the electrical conductivity of a contact material in accordance with the invention can be increased without an increase of the metal powder content in the contact material if part of the polymeric material is replaced by an electrically non-conducting inorganic powder consisting of particles having a high ratio of volume to surface area. By the provision of such an electrically non-conducting inorganic powder the volume which contains metal powder will be reduced so that the formation of current paths will be promoted. The activity of such inorganic additional filler will depend on the shape and size of its particles. A preferred filler consists of particles having a spherical shape and a size not in excess of 300 μm, preferably not in excess of 100 μm. Besides, the particle size of the metal powder should be smaller by a factor of 10 to 20 than the particle size of the inorganic additional filler because with such particle sizes the formation of chains of the meal particles around the particles of the additional filler will be facilitated.

The content of said additional filler in the contact material should not exceed 40 volume percent and should preferably lie in the range from 25 to 35 volume percent. If the content of the additional filler is higher, it will excessively reduce the arc-quenching properties and will excessively increase the burn-off. Particularly suitable electrically non-conducting inorganic fillers include, e.g., rock meal nd quartz powder or preferably a glass powder.

The addition of an electrically non-conducting ionorganic filler (quartz powder) has albo been proposed in U.S. Pat. No. 4,011,426 but in that context said additional filler is not used to increase the electrical conductivity but to improve the current-limiting activity exhibited by a switch as its two contacts are separated and in the prior art, only one of said two contacts contains the electrically non-conducting inorganic filler. Besides, U.S. Pat. No. 4,011,426 does not propose to select the particle sizes of the starting powders in the special manner proposed in connection with the present invention. In U.S. Pat. No. 4,011,426 it has been recommended to provide all starting powders in the same particle size range from 2 to 5 μm so that the electrical conductivity is lower than that of a material which does not contain such filler.

In a new method of making the material in accordance with the invention a metal powder and optionally the electrically non-conducting inorganic filler are provided, particularly with the stated particle sizes, and said materials are mixed preferably in a dry state with a thermosettable molding compound, which has previously been powdered. Said thermosettable compound is thermosettable without a formation of a liquid phase. The molding compound is preferably powdered in that granules of the thermosettable molding compound are ground. It is known in the art that such granules can be ground at low temperatures. The granules are preferably ground to form a powder consisting of particles below 300 μm, preferably below 100 μm. When the powders have been mixed, the resulting mixture is compacted, preferably without a supply of heat, to form compacts, which are subsequently cured by a supply of heat and under pressure. Because the curing does not involve the formation of a liquid phase, the molding compound will not completely envelop a substantial part of the metal powder particles; such totally enveloped particles would not be available for the formation of current paths.

Examples of the contact material in accordance with the invention will now be described.

EXAMPLE 1

The molding compound employed consisted of an unsaturated polyester resin, namely, Type 804 in accordance with DIN 16911. That molding compound was ground at room temperature to form a powder, which was sieved through a sieve having mesh openings of 200 μm. 88 volume percent of the powdered molding compound having a particle size below 200 μm were mixed in a dry state with 12 volume percent of a silver flake powder having a mean particle size of 9 μm. Under a pressure of $1.2\times10^8$ to $1.5\times10^8$ N/m$^2$, the resulting mixture was compacted in the cold to form tablets, which were subsequently cured at a temperature of 165° C. and under a pressure of $1,8\times10^8$ to $2.2\times10^8$ N/m$^2$.

The resulting material has an electrical conductivity of about 0.5 MS/m and has satisfactory arc-quenching properties and a high resistance to burning. A comparison with the material described in lines 26 to 65 of column 6 of U.S. Pat. No. 4,011,426 revealed in that in the switching of currents of 400 amperes with a contact separation within 10 ms the burn-off of the known material amounts to 60 mg per braking operating whereas the material in accordance with the invention exhibited only a burn-off of 11 mg.

EXAMPLE 2

The molding compound employed consisted of an unsaturated polyester resin molding compound of Type 3615 available from Bakelite GmbH in D-5860 Iserlohn. Said molding compound was ground at room temperature to form a powder, which was sieved through a sieve having mesh openings of 100 μm. 88% of the powdered molding compound having a particle size below 100 μm were mixed in a dry state with 12% of a silver flake powder having a mean particle size of 9 μm. The resulting mixture was compacted in the cold under a pressure of $1.2\times10^8$ to $1.5\times10^8$ N/m$^2$ to form tablets, which were subsequently cured at a temperature of 165° C. and under a pressure of $1.8\times10^8$ to $2.2\times10^8$ N/m$^2$.

The resulting material has a higher conductivity but a lower arc-quenching activity than the material described in Example 1.

Example 3

The molding compound employed consists of an epoxy resin molding composition of Type 870 in accordance with the withdrawn standard DIN 16912. That molding compound was ground at room temperature to form a powder, which was sieved through a screen having a mesh size of 100 μm. 88 volume percent of the powdered molding compound having a particle size below 100 μm were mixed in a dry state with 12 volume percent of a silver flake powder having a mean particle size of 9 μm. The resulting mixture was compacted in the cold under a pressure of $1.2\times10^8$ to $1.5\times10^8$ N/m$^2$ to form tablets, which were subsequently cured at a temperature of 165° C. under a pressure of $1.8\times10^8$ to $2.2\times10^8$ N/m$^2$.

The resulting material has a higher conductivity and a higher arc-quenching activity than the material described in Example 1.

EXAMPLE 4

The molding compound employed consisted of a melamine resin molding compound of Type 152 in accordance with DIN 7708. That molding compound was ground at room temperature to form a powder, which was screened through a screen having a mesh size of 100 μm. 88 volume percent of the powdered molding compound having a particle size below 100 μm were mixed in a dry state with 12 volume percent of a silver flake powder having a mean particle size of 9 μm. The resulting mixture was compacted in the cold under a pressure of $1.2\times10^8$ to $1.5\times10^8$ N/m$^2$ to form tablets, which were subwequently cured at a temperature between 155° and 160° C. and under a pressure of $1.8\times10^8$ to $2.2\times10^8$ N/m$^2$.

That material has a lower electric conductivity but a much higher arc-quenching activity than the material described in Example 1.

EXAMPLE 5

Example 4 was modified in that the contact material contained 30 volume percent glas spheres, 58 volume percent of the molding compound, and 12 volume percent silver ppowder. Glass spheres were used which were ≦0.1 mm in diameter.

The resulting material has the highest the highest electrical conductivity of all fine examples and its arc-quenching activity is approximately as satisfactory as that of the material obtained in Example 1.

In Examples 1 to 4, the electrical conductivity can be improved in that part of the thermosettable molding compound is replaced by glass spheres. The inventors have recognized that an attempt to increase the electrical conductivity by an increase of the metal content of the material would result in the disadvantage that the arc-quenching activity would distinctly be reduced because a material having a higher metal content would exhibit a higher undersired vaporization of metal under the action of an electric arc. That disadvantage is avoided by the use of a non-conducting inorganic powder.

It is believed that the low burn-off of contacts made in accordance with the invention is due to the fact that the cured polymers have a high arc-quenching activity and that the action of an electric arc on the surface of the contact does not result in the formation of a molten phase, which would result in a higher burn-off, by experience, and would cause current paths to be interrupted so that the contact resistance would be increased. On the other hand, the metal powder content is so low that the contact elements made of the novel material have an adequate strength in spite of the presence of the additional filler consisting of an electrically non-conducting inorganic powder.

We claim:

1. A composite material for electric contacts having arc quenching properties and comprising 5 to 20 volume percent of a metal powder having a particle size in the range of 0.5 μM to 20 μM and further comprising as a binder a polymer composition made from a powdered molding material which is compacted and cured without formation of a liquid phase and exhibits a particle size which is about ten to twenty times the mean particle size of the metal powder and does not exceed 300 μM.

2. A material according to claim 1, characterized in that it contains 8 to 12 volume percent of the metal powder.

3. A material according to claim 1,characterized in that the metal powder consists mainly of flakes.

4. A material according to claim 1, characterized in that the metal powder has a particle size in the range from 0.5 μM to 10 μM and that the powdered molding material is sieved to have a particle size not exceeding 100 μM.

5. A material according to claim 1, characterized in that it contains in an amount of up to 40 volume percent an additional filler consisting of an electrically non-conducting inorganic powder, the particles of which are spheroidal or predominantly spheroidal in shape.

6. A material according to claim 5, characterized in that it contains 25 to 35 volume percent of said additional filler.

7. A material according to claim 5, characterized in that the additional filler consists of glass.

8. A material according to claim 5, characterized in that the additional filler has a particle size not exceeding 300 μM.

9. A material according to claim 5, characterized in that the additional filler has a particle size not exceeding 100 μM.

10. A material according to claim 5, characterized in that said additional filler has a particle size of at least 50 μM.

11. A material according to claim 5, characterized in that the particle size of said additional filler is ten to twenty times the mean particle size of the metal powder.

12. A material according to claim 1, characterized in that the curable polymer is selected from the group consisting of the molding materials of Type 802 according to DIN 16 911, Type 3515 available from Bakelite GmbH in D-5680 Iserlohn (an unsaturated polyester resin containing a spherical inorganic filler), Type 870 in accordance with the withdrawn DIN 16 912 and Type 152 in accordance with DIN 7708.

13. A method of manufacturing a composite material for electric contacts having arc-quenching properties and comprising 5 to 20 volume percent of a metal powder having a particle size in the range from 0.5 μM to 20 μM, further comprising 0 to 40 volume percent of an electrically non-conducting inorganic filler in powder form and finally comprising a cured polymer composition selected to be a thermo-settable molding material which can be cured without formation of a liquid phase, the method comprising the steps of grinding the molding material to form a powder, sieving the powdered molding material to have a particle size not exceeding 300 μM, mixing the powders, compacting the powder mixture, and curing the resulting compacts under pressure and with a supply of heat without formation of a liquid phase.

14. A method according to claim 13, characterized in that the powdered molding material is sieved to have a particle size not exceeding 100 μM.

15. A method according to claim 13, characterized in that the particles of the powdered molding material and of said additional filler have approximately the same particle size.

16. A method according to claim 13, characterized in that the powders are mixed in a dry state and are compacted in the cold and the resulting compacts are cured.

17. A composite material for electric contacts having arc quenching properties and comprising 5 to 20 volume percent of a metal powder having a particle size in the range from 0.5 μM to 10 μM and further comprising as a binder a polymer composition made from a powdered molding material which is compacted and cured without formation of a liquid phase and exhibits a particle size which is about ten to twenty times the mean particle size of the metal powder and does not exceed 100 μM.

18. A material according to claim 17, characterized in that it contains 8 to 12 volume percent of the metal powder.

19. A material according to claim 17, characterized in that the metal powder consists mainly of flakes.

20. A material according to claim 17, characterized in that it contains in an amount of up to 40 volume percent an additional filler consisting of an electrically non-conducting inorganic powder, the particles of which are spheroidal or predominantly spheroidal in shape.

21. A material according to claim 20, characterized in that it contains 25 to 35 volume percent of said additional filler.

22. A material according to claim 20, characterized in that the additional filler consists of glass.

23. A material according to claim 20, characterized in that the additional filler has a particle size not exceeding 300 μM.

24. A material according to claim 20, characterized in that the additional filler has a particle size not exceeding 100 μM.

25. A material according to claim 20, characterized in that said additional filler has a particle size of at least 50 μM.

26. A material according to claim 20, characterized in that the particle size of said additional filler is ten to twenty times the mean particle size of the metal powder.

27. A material according to claim 17, characterized in that the curable polymer is selected from the group consisting of the molding materials of Type 802 according to DIN 16 911, Type 3515 available from Bakelite GmbH in D-5680 Iserlohn (an unsaturated polyester resin containing a spherical inorganic filler), Type 870 in accordance with the withdrawn DIN 16 912 and Type 152 in accordance with DIN 7708.

28. A method of manufacturing a composite material for electric contacts having arc-quenching properties and comprising 5 to 20 volume percent of a metal powder having a particle size in the range from 0.5 μM to 10 μM, further comprising 0 to 40 volume percent of an electrically non-conducting inorganic filler in powder form, and finally comprising a cured polymer composition selected to be a thermo-settable molding material which can be cured without formation of a liquid phase, the method comprising the steps of grinding the molding material to form a powder, sieving the powdered molding material to have a particle size not exceeding 100 μM, mixing the powders, compacting the powder mixture, and curing the resulting compacts under pressure and with a supply of heat without formation of a liquid phase.

29. A method according to claim 28, characterized in that the particles of the powdered thermo-settable molding material and of said additional filler have approximately the same particle size.

30. A method according to claim 28, characterized in that the powders ar mixed in a dry state and are compacted in the cold and the resulting compacts are cured.

31. A composite material for electric contacts having arc-quenching properties and comprising 5 to 20 volume percent of a metal powder consisting mainly of flakes and having a particle size in the range from 0.5 μM to 20 μM and further comprising as a binder a polymer composition made from a powdered molding material which is compacted and cured without formation of a liquid phase and exhibits a particle size which is about ten to twenty times the mean particle size of the metal powder and does not exceed 300 μM.

32. A material according to claim 31, characterized in that it contains 8 to 12 volume percent of the metal powder.

33. A material according to claim 31, characterized in that the metal powder has a particle size in the range form 0.5 μM to 10 μM.

34. A material according to claim 31, characterized in that it it contains in an amount of up to 40 volume percent an additional filler consisting of an electrically non-conducting inorganic powder, the particles of which are spheroidal or predominantly spheroidal in shape.

35. A material according to claim 34, characterized in that it contains 25 to 35 volume percent of said additional filler.

36. A material according to claim 34, characterized in that the additional filler consists of glass.

37. A material according to claim 34, characterized in that the additional filler has a particle size not exceeding 300 μM.

38. A material according to claim 34, characterized in that the additional filler has a particle size not exceeding 100 μM.

39. A material according to claim 34, characterized in that said additional filler has a particle size of at least 50 μM.

40. A material according to claim 34, characterized in that the particle size of said additional filler is ten to twenty times the mean particle size of the metal powder.

41. A material according to claim 31, characterized in that the curable polymer is selected from the group consisting of the molding materials of Type 802 according to DIN 16 911, Type 3515 available from Bakelite GmbH in D-5680 Iserlohn (an unsaturated polyester resin containing a spherical inorganic filler), Type 870 in accordance with the withdrawn DIN 16 912 and Type 512 in accordance with DIN 7708.

* * * * *